US008212166B2

(12) United States Patent
Yeh et al.

(10) Patent No.: US 8,212,166 B2
(45) Date of Patent: Jul. 3, 2012

(54) SWITCH ASSEMBLY

(75) Inventors: Chin-Wen Yeh, Taipei Hsien (TW); Zhen-Neng Lin, Shenzhen (CN); Jian-Guo An, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 205 days.

(21) Appl. No.: 12/724,372

(22) Filed: Mar. 15, 2010

(65) Prior Publication Data

US 2011/0120847 A1 May 26, 2011

(30) Foreign Application Priority Data

Nov. 25, 2009 (CN) ..... 2009 2 0315736 U

(51) Int. Cl.
*H01H 3/12* (2006.01)

(52) U.S. Cl. ..... 200/341

(58) Field of Classification Search ..... 200/520, 200/314, 573, 342–345, 5 A, 22, 271, 538
See application file for complete search history.

(56) References Cited

U.S. PATENT DOCUMENTS

| | | | | |
|---|---|---|---|---|
| 7,554,047 | B2 * | 6/2009 | Verdu et al. | 200/314 |
| 2005/0077163 | A1 * | 4/2005 | Adams et al. | 200/341 |
| 2005/0224329 | A1 * | 10/2005 | Milo | 200/341 |

FOREIGN PATENT DOCUMENTS

JP 2004057380 A * 2/2004

* cited by examiner

*Primary Examiner* — Edwin A. Leon
(74) *Attorney, Agent, or Firm* — Altis Law Group, Inc.

(57) ABSTRACT

A switch assembly includes a panel defining a receiving portion. The receiving portion includes two opposite first sidewalls, two opposite second sidewalls, and a bottom wall connected between the first sidewalls. A switch member is attached to the panel. An actuating member is accommodated in and engaged with the second sidewalls of the receiving portion. The actuating member includes a pressing plate. Two guiding walls extend from two opposite first sides of the pressing plate, and two elastic hooks protruding from two opposite second sides of the pressing plate. A spring member is disposed between the pressing plate of the actuating member and the bottom wall of the receiving portion, to provide resilient force to expose the actuating member outside of the panel.

17 Claims, 6 Drawing Sheets

SWITCH ASSEMBLY

BACKGROUND

1. Technical Field

The present disclosure relates to switch assemblies, particularly, to a switch assembly for an electronic device.

2. Description of Related Art

An electronic device, such as a computer, usually includes an enclosure to accommodate electronic components, and a bezel mounted to the enclosure. Switches are arranged to activate some functions of the computer and buttons are used to activate the switches. Conventionally, each button includes a pressing post to trigger the switch, and a plurality of guiding posts. The bezel defines a plurality of holes corresponding to the pressing post and guiding posts. However, in the process of pressing a button, the pressing plate of the button may be deformed. Further, the guiding posts may also deform, and may be blocked by the hole edges of the bezel. Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
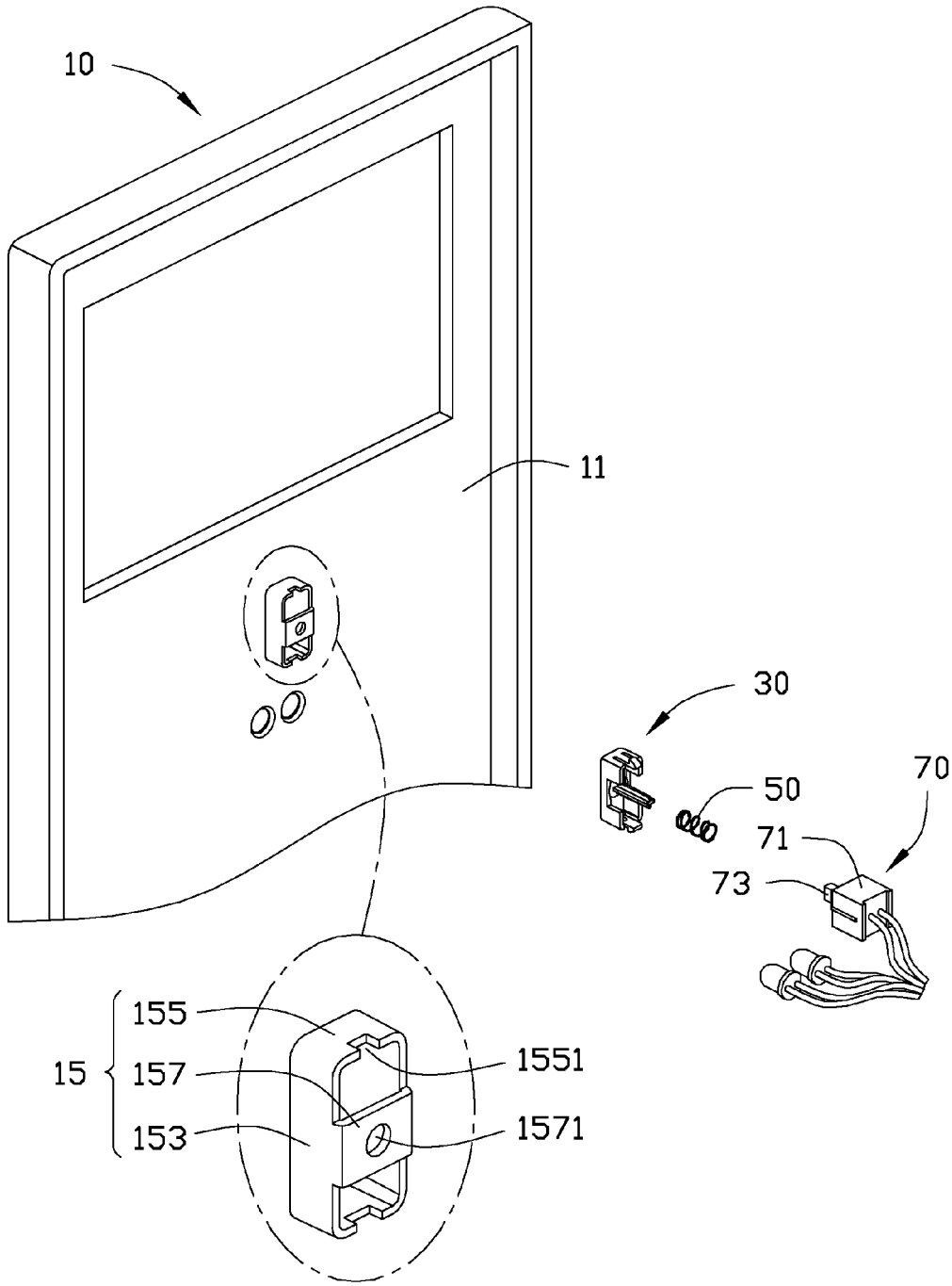
FIG. 1 is an exploded, isometric view of a switch assembly in accordance with an embodiment.
Figure 2:
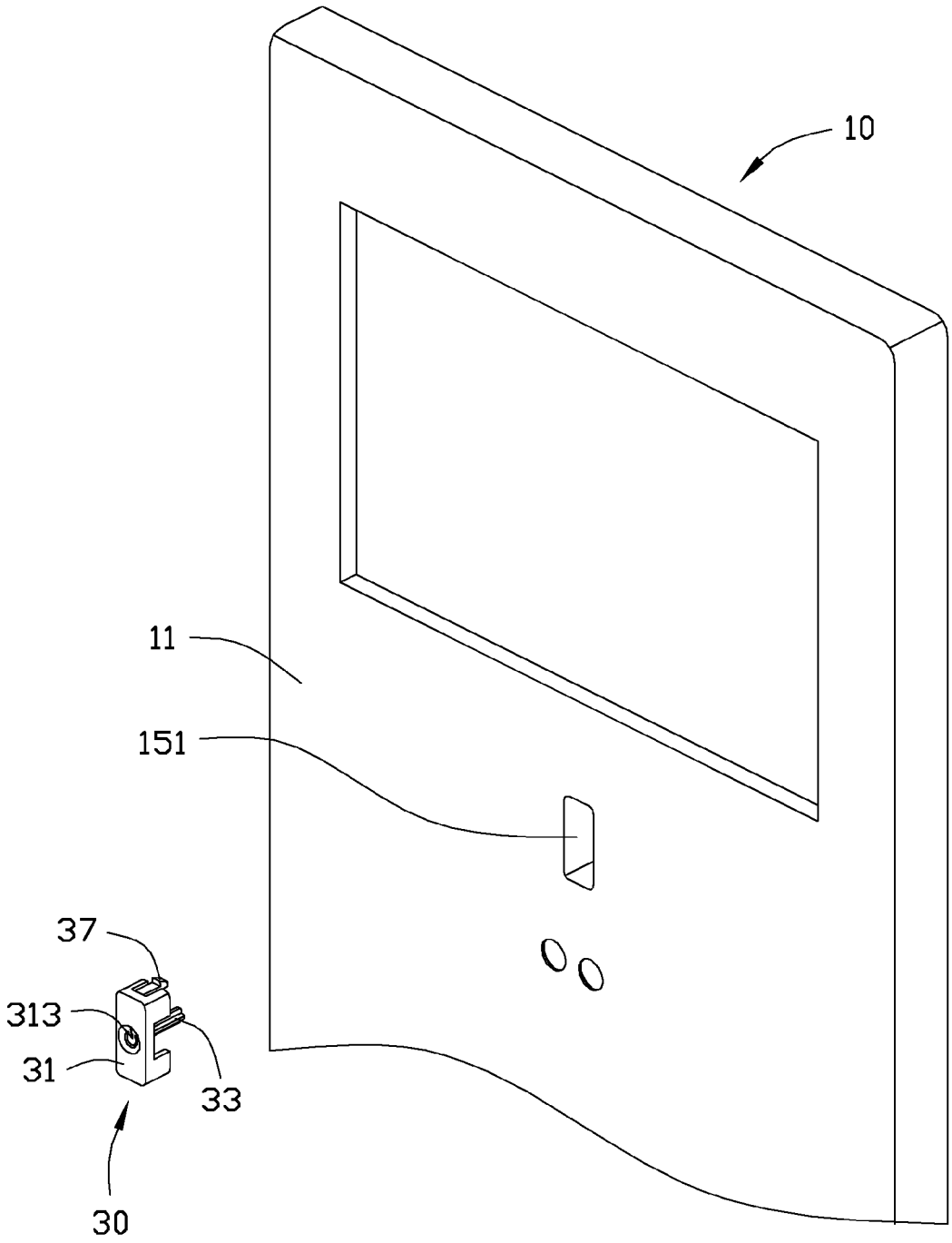
FIG. 2 is an exploded, isometric view of a bezel and an actuating member of FIG. 1, but viewed in a different aspect.

Referring to FIGS. 1 and 2, an switch assembly in accordance with one embodiment includes a panel 10, an actuating member 30, a spring member 50, and a switch member 70.

The panel 10 includes a base 11. An opening 151 is defined in the base 11. Two opposite first sidewalls 153 and two opposite second sidewalls 155 extend from the base 11 and are adjacent to edges of the opening 151. Each second sidewall 155 defines a positioning cutout 1551 at an outer edge. A bottom wall 157 is connected between the first sidewalls 153. The bottom wall 157 defines a through hole 1571 in a center thereof. In one embodiment, the base 11 and opening 151 is rectangular. The first sidewalls 153, the second sidewalls 155, and the bottom wall 157 cooperatively define a receiving portion 15 to accommodate the switch member 70

Figure 3:
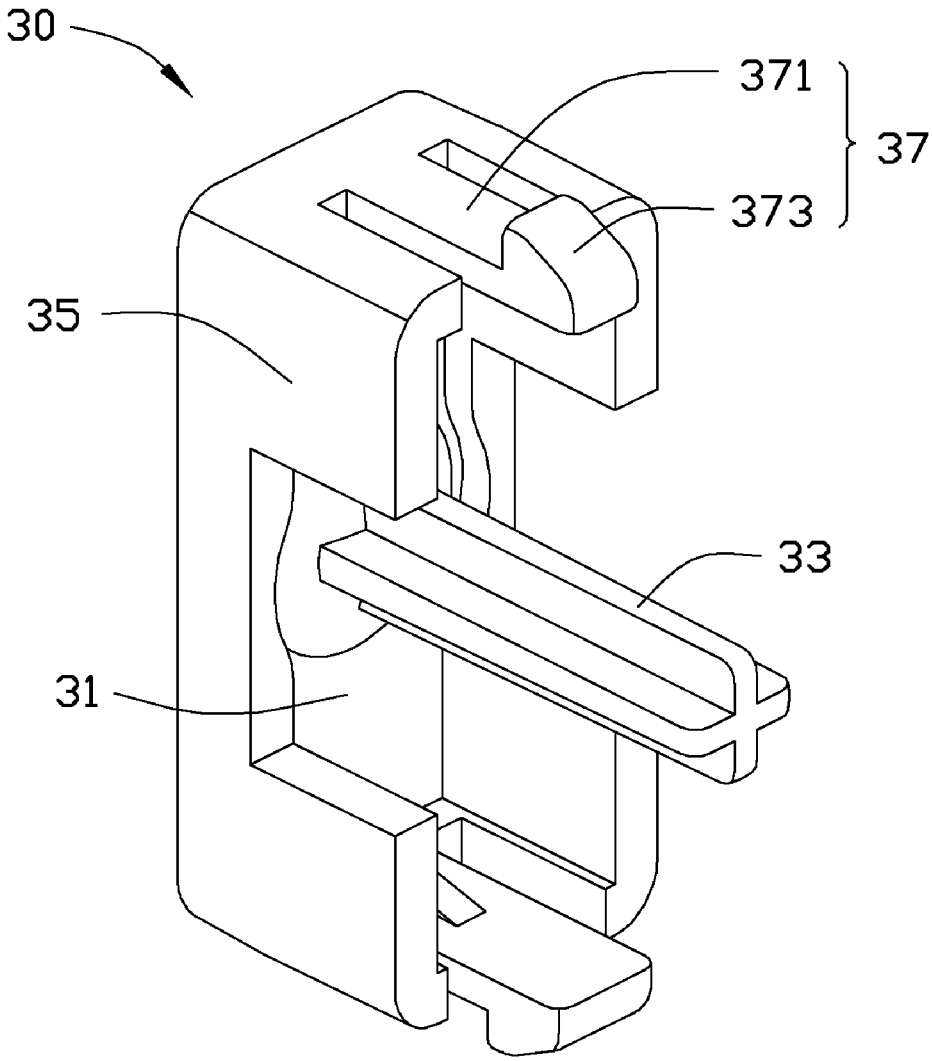
FIG. 3 is an isometric view of the actuating member of FIG. 1.

Referring to FIGS. 2 and 3, the actuating member 30, includes a pressing plate 31, which is substantially the same shape as the opening 151 in the panel 10. The pressing plate 31 defines a recess operating portion 313. A pressing post 33 protrudes from the pressing plate 31 at a position corresponding to the recess operating portion 313. Two spaced guiding walls 35 respectively extend from each of two opposite sides of the pressing plate 31. The guiding walls 35 are symmetrically disposed around the pressing posts 33. The recess operating portion 313 and the guiding walls 35 are configured to strengthen the stability of the actuating member 30. Two elastic hooks 37 protrude from the other opposite sides of the pressing plate 31. Each of the elastic hooks 37 includes an elastic arm 371 and a locking portion 373.

Referring to FIG. 1, the switch member 70 includes a base 71 configured to electrically connected to a electronic component (not shown), and a switch portion 73 is resiliently disposed in the base 71. The switch portion 73 is capable of being retracted into the base 71 to activate the switch member 70.

Figure 4:
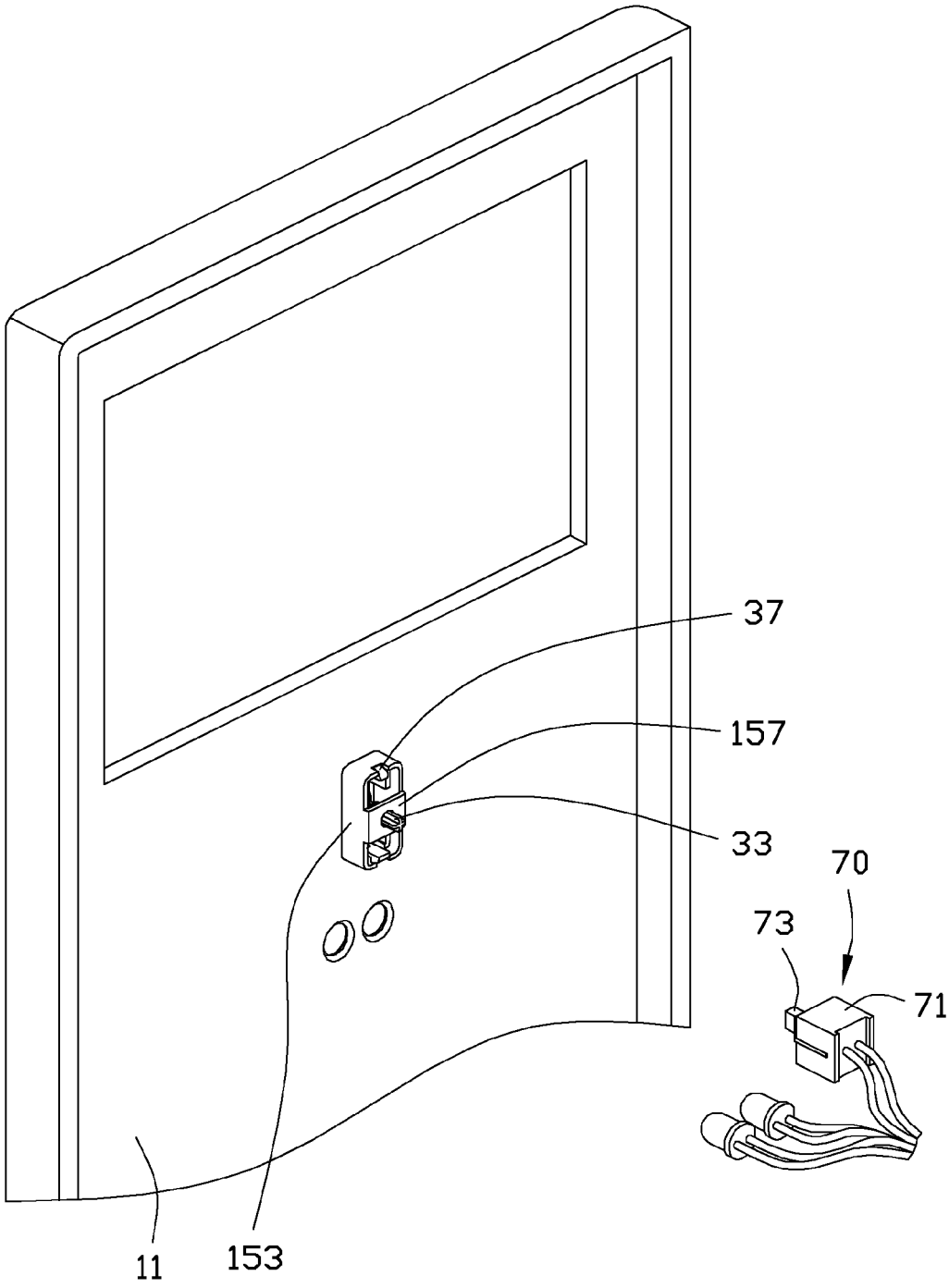
FIG. 4 is an assembled view of FIG. 1, with the switching member removed.
Figure 5:
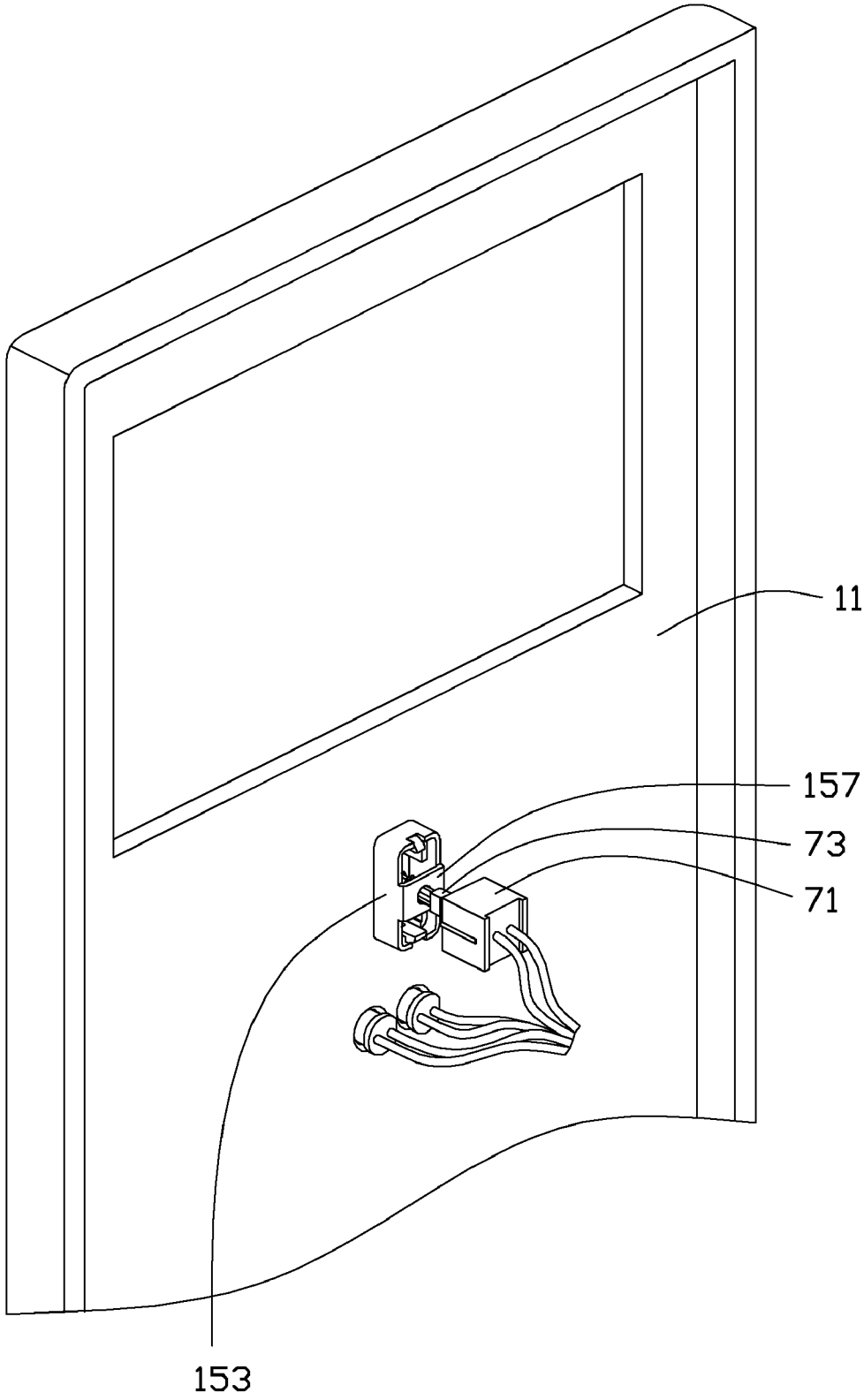
FIG. 5 is an assembled view of FIG. 4, and showing the switching member in an initial state.
Figure 6:
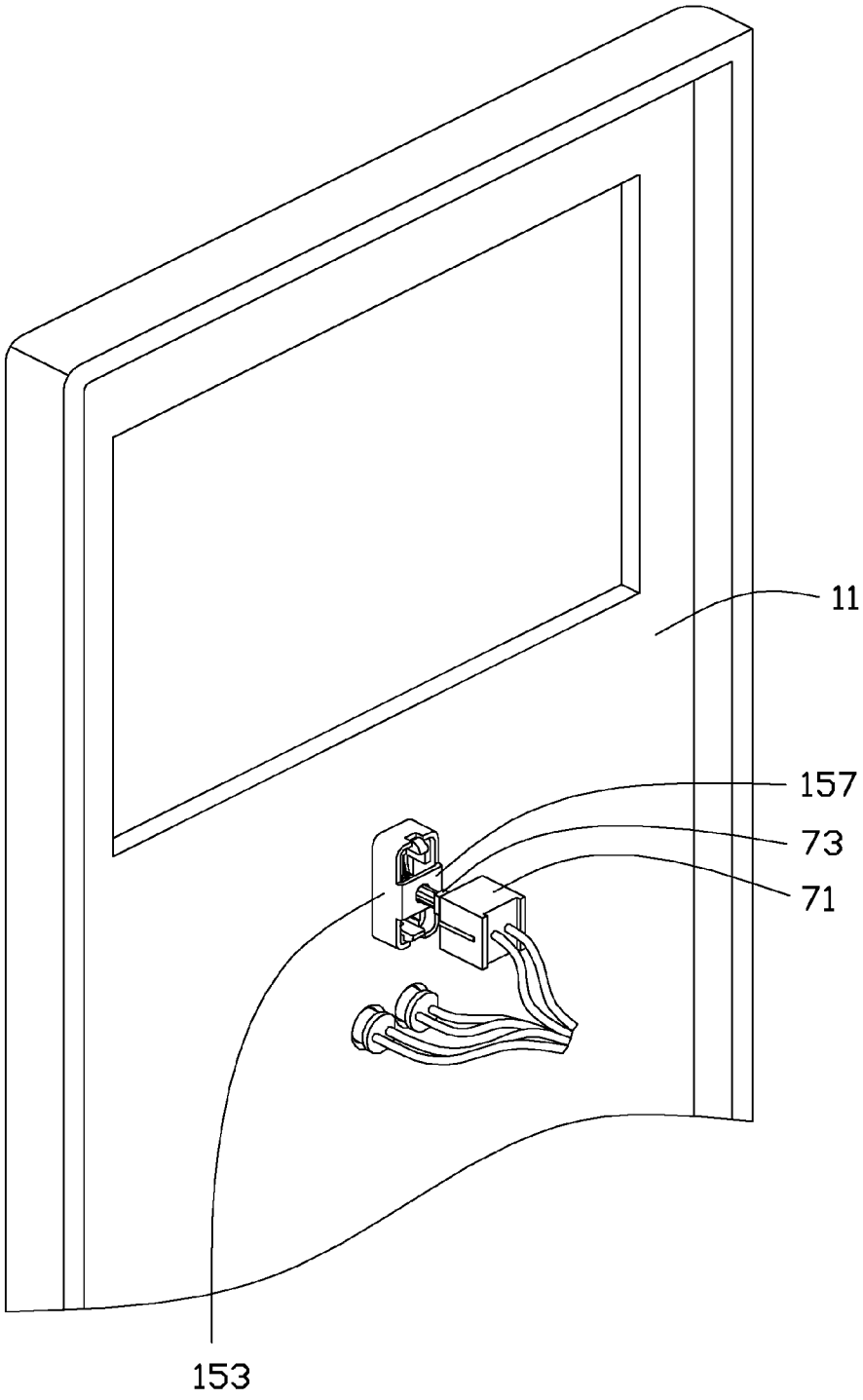
FIG. 6 is similar to FIG. 5, with the switch member retracted.

Also referring to FIGS. 4 to 6, in assembly, the spring member 50 is disposed around the pressing post 33 of the actuating member 30 (see FIG. 1). The actuating member 30 with the spring member 50 is accommodated in the receiving portion 15. The guiding walls 35 slide along the first sidewalls 153 of the receiving portion 15 and abut the sidewalls 153. The elastic hooks 37 slide along the second sidewall 155, and engage with the positioning cutout 1551. The pressing post 33 extend through the through hole 1571 in the bottom wall 157 of the receiving portion 15. The spring member 50 is disposed between the bottom wall 157 of the receiving portion 15 and the pressing plate 31 of the actuating member 30. In an initial state, the spring member 50 is slightly deformed, thereby allowing the engagement of the locking portions 373 of the elastic hooks 37 in the positioning cutout 1551, to stably accommodate the actuating member 30 in the receiving portion 15. The pressing plate 31 extends through the opening 151 of the receiving portion 15, being exposed to the outside of the panel 11, making it accessible to operate the actuating member 30.

Then, the switch member 70 is attached to the bezel 10. The switch portion 73 aligns with the pressing post 33 of the actuating member 30. When the actuating member 30 is pushed, the switch 73 is pressed down by the pressing post 33, to actuate the switch member 70.

When in use, the recess operating portion 313 of the actuating member 30 is pressed. The actuating member 30 moves along the first sidewall 153 and the second sidewall 155 of the receiving portion 15. The pressing post 33 of the actuating member 30 moves through the through hole 1571 to push the switch portion 73 to retract in the base 71 of the switch member 70, thereby activating an electronic device. Then, the actuating member 30 is released, and the spring member 50 rebounds back to move the actuating member 30 towards the outside of the panel 10. When the locking portion 373 of the elastic hook 37 is engaged in the positioning slot 1551 of the second sidewall 155, the actuating member 30 goes back to the initial state for the next operation.

It is to be understood, however, that even though numerous characteristics and advantages of the embodiments have been set forth in the foregoing description, together with details of the structure and function of the present disclosure, the disclosure is illustrative only, and changes may be made in detail, especially in matters of shape, size, and arrangement of parts within the principles of the embodiments to the full extent indicated by the broad general meaning of the terms in which the appended claims are expressed.

What is claimed is:

1. A switch assembly, comprising:

a panel defining a receiving portion, the receiving portion comprising two opposite first sidewalls, two opposite second sidewalls and a bottom wall connected between the first sidewalls;

a switch member attached to the panel;

an actuating member accommodated in and engaged with the receiving portion, the actuating member comprising a pressing plate; two guiding walls extending from two opposite first sides of the pressing plate; two elastic hooks protruding from two opposite second sides of the pressing plate and engaging with the two second sidewalls of the panel; and a spring member disposed between the pressing plate of the actuating member and the bottom wall of the receiving portion, to provide resilient force to expose the actuating member outside of the panel.

2. The switch assembly of claim 1, wherein the receiving portion defines an opening, and the pressing plate is exposed outside of the panel from the opening.

3. The switch assembly of claim 1, wherein the bottom wall of the receiving portion defines a hole; a pressing post protrudes from the pressing plate of the actuating member; and the pressing post is inserted through the hole.

4. The switch assembly of claim 3, wherein the spring member is disposed around the pressing post.

5. The switch assembly of claim 1, wherein each of the two second sidewalls defines a cutout, and each of the two elastic hooks is engaged in the cutout.

6. The switch assembly of claim 1, wherein the two guiding walls are symmetrically disposed around the pressing posts.

7. A switch assembly, comprising:

a panel defining a receiving portion, the receiving portion comprising a bottom wall, two opposite first sidewalls and two opposite second sidewalls, the bottom wall connected between the two opposite first sidewalls;

a switch member attached to the panel; and an actuating member elastically accommodated in the receiving portion and engaged with the two second sidewalls of the receiving portion; the actuating member comprising a pressing plate; two elastic hooks protruding from two opposite second sides of the pressing plate and engaging with the two second sidewalls of the panel; and a pressing post protruding from the pressing plate to actuate the switch member;

wherein the bottom wall is located between the two elastic hooks.

8. The switch assembly of claim 7, wherein the receiving portion defines an opening, the pressing plate is received in the opening and exposed outside the panel for accessible to actuate the switch member.

9. The switch assembly of claim 7, wherein at least one of the two elastic hook protrudes from the pressing plate and engages with one of the two second sidewalls.

10. The switch assembly of claim 7, wherein the bottom wall defines a hole, and the pressing post inserts through the hole to actuate the switch member.

11. The switch assembly of claim 10, wherein a spring member is disposed between the pressing plate and the bottom wall, around the pressing post.

12. The switch assembly of claim 9, wherein each of the two second sidewalls defines a cutout, and each of the two elastic hooks is engaged in the cutout.

13. The switch assembly of claim 7, wherein the at least two guiding walls protrude from the two opposite side edges of the pressing plate, and are symmetrically disposed around the pressing posts.

14. A switch assembly, comprising:

a panel defining a receiving portion, the receiving portion comprising two opposite first sidewalls and two second sidewalls opposite to each other, and a bottom wall connected between the two first sidewalls, the bottom wall defining a hole;

a switch member attached to the panel;

an actuating member accommodated in and engaged with the receiving portion, the actuating member comprising a pressing plate; two elastic hooks protruding from two opposite second sides of the pressing plate and engaging with the two second sidewalls of the panel; a pressing post protruding from the pressing plate and inserted through the hole; the pressing post located between the two elastic hooks; and each of the two elastic hooks being located out side of the hole; and a spring member disposed between the pressing plate of the actuating member and the bottom wall of the receiving portion, to provide resilient force to expose the actuating member outside of the panel.

15. The switch assembly of claim 14, wherein the receiving portion defines an opening, and the pressing plate is exposed outside of the panel from the opening.

16. The switch assembly of claim 14, wherein the spring member is disposed around the pressing post.

17. The switch assembly of claim 14, wherein each of the two second sidewalls defines a cutout, and each of the two elastic hooks is engaged in the cutout.

* * * * *